US007202844B2

(12) United States Patent
Nakamigawa

(10) Patent No.: US 7,202,844 B2
(45) Date of Patent: Apr. 10, 2007

(54) LIQUID CRYSTAL DISPLAY CONTROLLER AND LIQUID CRYSTAL DISPLAY

(75) Inventor: Kazuhiro Nakamigawa, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 584 days.

(21) Appl. No.: 09/726,721

(22) Filed: Nov. 30, 2000

(65) Prior Publication Data

US 2001/0002828 A1 Jun. 7, 2001

(30) Foreign Application Priority Data

Dec. 2, 1999 (JP) ..... 11-343960

(51) Int. Cl.
*G09G 3/36* (2006.01)

(52) U.S. Cl. ..... 345/89; 345/211

(58) Field of Classification Search ..... 345/87, 345/88, 90, 92, 98, 89, 104, 211, 96, 690; 349/37, 43, 42; 315/169.2
See application file for complete search history.

(56) References Cited

U.S. PATENT DOCUMENTS

| | | | | |
|---|---|---|---|---|
| 4,892,389 | A * | 1/1990 | Kuijk | 345/89 |
| 5,006,838 | A * | 4/1991 | Fujioka et al. | 345/79 |
| 5,196,738 | A * | 3/1993 | Takahara et al. | 327/530 |
| 5,541,619 | A * | 7/1996 | Hayashi et al. | 345/96 |
| 5,621,283 | A * | 4/1997 | Watson et al. | 315/362 |
| 5,854,879 | A * | 12/1998 | Inuzuka et al. | 345/89 |
| 5,903,260 | A * | 5/1999 | Imamura | 345/211 |
| 5,923,546 | A * | 7/1999 | Shimada et al. | 363/40 |
| 5,990,940 | A * | 11/1999 | Hashimoto et al. | 348/184 |
| 6,140,989 | A * | 10/2000 | Kato | 345/89 |
| 6,151,005 | A * | 11/2000 | Takita et al. | 345/89 |
| 6,166,725 | A * | 12/2000 | Isami et al. | 345/209 |
| 6,181,313 | B1 * | 1/2001 | Yokota et al. | 345/100 |
| 6,292,182 | B1 * | 9/2001 | Park et al. | 345/211 |
| 6,490,013 | B2 * | 12/2002 | Koma | 349/33 |

FOREIGN PATENT DOCUMENTS

| | | |
|---|---|---|
| JP | S60-025290 | 2/1985 |
| JP | S63-113196 | 7/1988 |
| JP | S64-035483 | 2/1989 |
| JP | 04-194818 | 7/1992 |
| JP | 4-280290 | 10/1992 |
| JP | H04-280290 | 10/1992 |
| JP | H05-017702 | 2/1993 |
| JP | H08-171370 | 7/1996 |
| JP | H11-265172 | 9/1999 |
| KR | 1999-021959 | 3/1999 |
| WO | WO96/37875 | 11/1996 |

* cited by examiner

*Primary Examiner*—Richard Hjerpe
*Assistant Examiner*—Abbas Abdulselam
(74) *Attorney, Agent, or Firm*—Scully, Scott, Murphy & Presser, P.C.

(57) ABSTRACT

In a liquid crystal display controller, a digital image input signal is input to the controller for data-processing and output to a liquid crystal driver which drives a liquid crystal panel which can be normally white or normally black. The liquid crystal display controller comprises an inverter for inverting the digital image input signal, a selector for choosing and outputting the signal inverted by the inverter and the digital image input signal depending on a switching signal, and a data processor for controlling the voltage luminance (VT) of the signal transmitted by the selector and transmitting the signal to the liquid crystal driver.

8 Claims, 6 Drawing Sheets

FIG. 3A WHEN DRIVERS ARE ARRANGED AT BOTH SIDES OF LCD PANEL
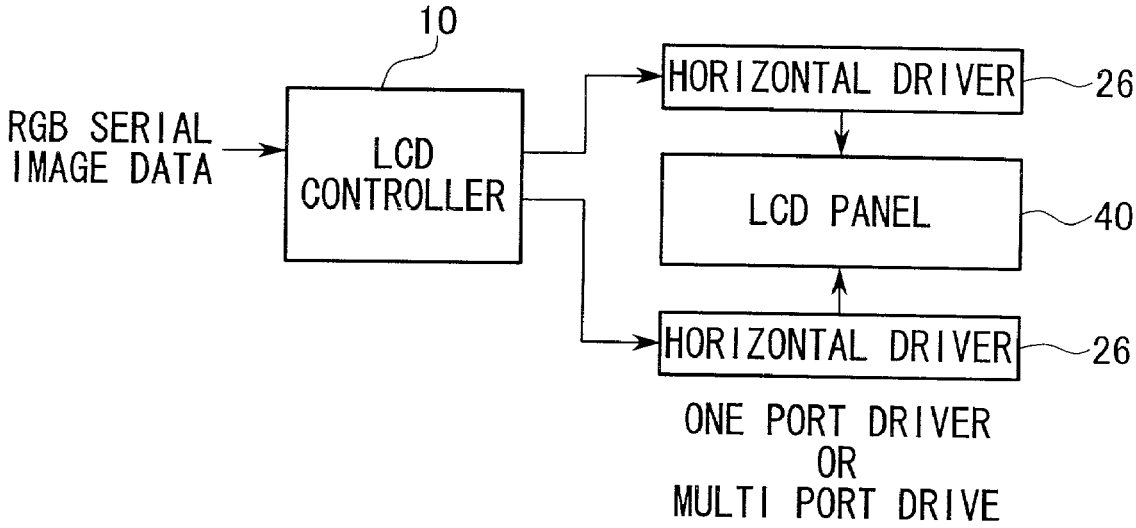
FIG. 3B WHEN A DRIVER IS ARRANGED AT ONE SIDE OF LCD PANEL
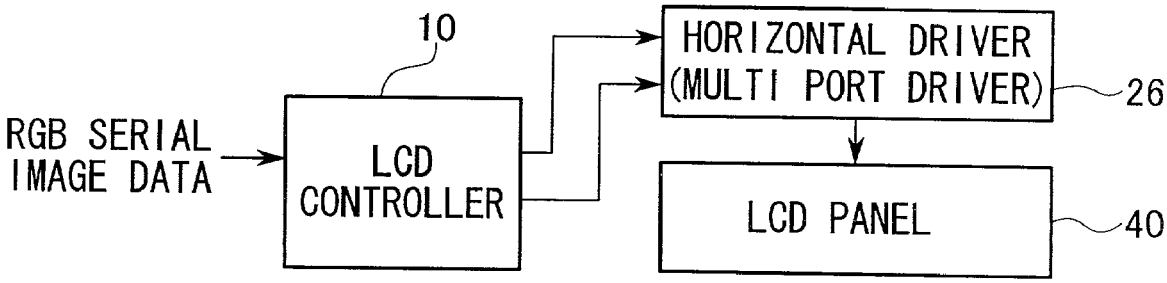

RELATION BETWEEN PIXEL ARRANGEMENT AND DRIVER CONNECTION (VGA)

A INDICATES DATA FOR ODD NUMBERS
B INDICATES DATA FOR EVEN NUMBERS

LIQUID CRYSTAL DISPLAY CONTROLLER AND LIQUID CRYSTAL DISPLAY

BACKGROUND OF THE INVENTION

1. Field of the Invention

The present invention relates to a liquid crystal display comprising a liquid crystal display controller which controls switching of a liquid crystal screen between normally white and normally black.

2. Description of Related Art Including Information Disclosed Under 37 CFR 1.97 and 37 CFR 1.98

Conventionally, normally white liquid crystal screens (hereinafter, also referred to as "NW") have been used for many portable devices such as a laptop type personal computers. The majority of normally white liquid crystals are twist nematic (TN) liquid crystals which have the problem that their angle of visibility is narrow. In the normally white mode, when a linearly polarized light axis of a first polarizing plate and a linearly polarized light axis of a second polarizing plate cross each other at right angles, and wherein light is transmitted into the liquid crystal display cell through the first and second plates, a voltage is applied to the liquid crystal display cell, and the light is blocked.

FIG. 6 is a block diagram showing a liquid crystal display having a normally white liquid crystal panel. In FIG. 6, input data (digital image input signal) is input into a controller for NW 12, voltage luminance (VT) of the input data is controlled by a data processor, and the input data controlled is input into a liquid crystal driver for NW 22. The liquid crystal driver for NW 22 is fed by a gradation power source 32 and displays images on a liquid crystal panel for NW 42 depending on the input data.

On the other hand, a normally black liquid crystal screen (hereinafter, also referred to as "NB") have been used for monitors. Particularly, when the screen size is 16 inches or more, the dependency of the angle of visibility increases, therefore, a wide angle of visibility is desired. The majority of normally black liquid crystals are transverse electric field liquid crystals. The problems posed by TN liquid crystals such as a narrow angle of visibility, are solved by adopting a transverse electric field driving type of the liquid crystal cell. However, transverse electric field liquid crystals are manufactured by a more complex process than the manufacturing process for TN liquid crystals, so that the manufacturing costs increase. When a wide angle of visibility is not required, therefore, TN liquid crystals have been used. In the normally black mode, when the linearly polarized light axis of the first polarizing plate and the linearly polarized light axis of the second polarizing plate overlap, a voltage is applied to the liquid crystal display cell, and light is transmitted.

FIG. 7 is a block diagram showing a liquid crystal display having a normally black liquid crystal panel. In FIG. 7, an input data is input to a controller for NB 14, the VT of the input data is controlled by the data processor, and the input data is input to a liquid crystal driver for NB 24. The liquid crystal driver for NB 24 is fed by the gradation power source 34 for the transverse electric field liquid crystal and displays images on an NB liquid crystal panel 44 depending on the input data. The digital image signal input to the NW liquid crystal panel 42 is exactly the opposite of the digital image signal input to the NB liquid crystal panel 44 in polarity. When the controller for NW 12 is combined with an inverter, the controller for NW 12 can function as the controller for NB 14. Furthermore, since TN liquid crystals have a narrow angle of visibility and are not suitable for large screens, TN liquid crystals or transverse electric field liquid crystals are chosen according to the size of the screen panel.

Recent TN liquid crystals have relatively wide angles of visibility by using the optical properties of a sheet for adhering the panels to each other. As a result, the TN liquid crystal can be chosen even if the size of the screen panel is about 18 inch and users can choose either normally white or normally black. However, if controllers for both NW and for NB are provided in a liquid crystal display, the problem that mass production is difficult for the manufacturer arises.

If an NB liquid crystal panel is controlled using the NW controller for NW liquid crystal panel, an arithmetic unit such as an inverter needs to be provided in the NW controller as an NB controller (see Japanese Examined Patent Application, Second Publication, No. Hei 7-46267). As a result, two controllers, one for an NW liquid crystal panel and another for an NB liquid crystal panel, are required, therefore, there is the problem that mass production cannot be carried out.

BRIEF SUMMARY OF THE INVENTION

An object of the present invention is to provide a liquid crystal display controller which controls the normally white mode and the normally black mode for a liquid crystal panel according to the user's choice between both modes in the liquid crystal panel.

To achieve the above-mentioned object, the liquid crystal display controller of the present invention into which a digital image input signal is input and data-processed and which outputs the digital image input signal to a liquid crystal driver 20 for driving normally white or normally black liquid crystal panel 40, comprises; an inverter 11 inverting the digital image input signal, a selector 13 choosing and outputting the signal inverted by the inverter 11 and the digital image input signal depending on a switching signal, a data processor 15 controlling the voltage luminance of the signal transmitted from the selector 13 and transmitting the signal to the liquid crystal driver 20.

In the above-mentioned display, when the liquid crystal panel 40 is normally white, the switching signal makes the selector 13 choose the digital image input signal because the digital image input signal may be simply input to the data processor 15. On the other hand, when the liquid crystal panel is normally black, the switching signal makes the selector 13 choose the output signal from the inverter 11 because the digital image input signal may be logically reversed and input to the data processor 15.

The switching signal may show whether the liquid crystal panel is normally white or normally black. The signal showing whether the liquid crystal panel is normally white or normally black can be regarded as the switching signal.

Furthermore, the switching signal may show whether the liquid crystal panel is a TN liquid crystal panel or a transverse electric field liquid crystal panel. In ordinary conditions for using the panels, TN liquid crystal panels are used as normally white and transverse electric field liquid crystal panels are used as normally black.

Furthermore, the switching signal may show whether a gradation power source provided depending on the type of the liquid crystal panel is provided for a TN liquid crystal panel or for a transverse electric field liquid crystal panel.

The type of the liquid crystal panel to be controlled can be determined by the gradation power source.

Furthermore, the data processor may generate a drive signal for a vertical driver and a drive signal for a horizontal driver to be transmitted to the liquid crystal driver when the digital image input signal comprises a pixel signal for RGB and scanning line information. According to this construction, a general liquid crystal driver can be used.

Furthermore, a liquid crystal display of the present invention comprises; a liquid crystal panel 40 being either normally white or normally black, a gradation power source 30 supplying voltage depending on the liquid crystal panel 40, a liquid crystal display controller 10 comprising an inverter 11 inverting a digital image input signal, a selector 13 choosing and outputting the signal inverted in the inverter and the digital image input signal depending on a switching signal, a data processor 15 processing data for showing the signal transmitted from the selector on the liquid crystal panel, and a liquid crystal driver 20 transmitting the digital image input signal data-processed in the liquid crystal display controller to the liquid crystal panel using electric power supplied by the gradation power source.

In the above-mentioned liquid crystal display, while the gradation power source 30 is prepared depending on the type of the liquid crystal panel 40, the liquid crystal display controller 10 and liquid crystal driver 20 can be used with no dependence on the type of liquid crystal panel 40. Therefore, mass production can be performed when assembling the display. In the liquid crystal display controller 10, the logic of the digital image input signal is switched depending on the switching signal, so that normally white or normally black can be chosen.

According to the liquid crystal display controller of the present invention, in the liquid crystal display wherein the liquid crystal panel can be chosen from the TN liquid crystal and the transverse electric field liquid crystal and normally white and normally black can be switched, the liquid crystal display controller and liquid crystal driver can be used with no dependence on the type of the liquid crystal panel and, therefore, mass production can be performed when assembling the display. In the liquid crystal display controller, since the logic of the digital image input signal is switched depending on the switching signal, it is possible to switch between normally white and normally black. Furthermore, in maintenance work, only one type of liquid crystal display controller can control normally white or normally black, therefore, the number of parts for maintenance work decreases and the cost also decreases.

BRIEF DESCRIPTION OF THE SEVERAL VIEWS OF THE DRAWING

FIGS. 3A and 3B are block diagrams showing arrangements of a parallel driver.

DETAILED DESCRIPTION OF THE INVENTION

An embodiment of the present invention will be explained with reference to the figures as follows.

Figure 1:
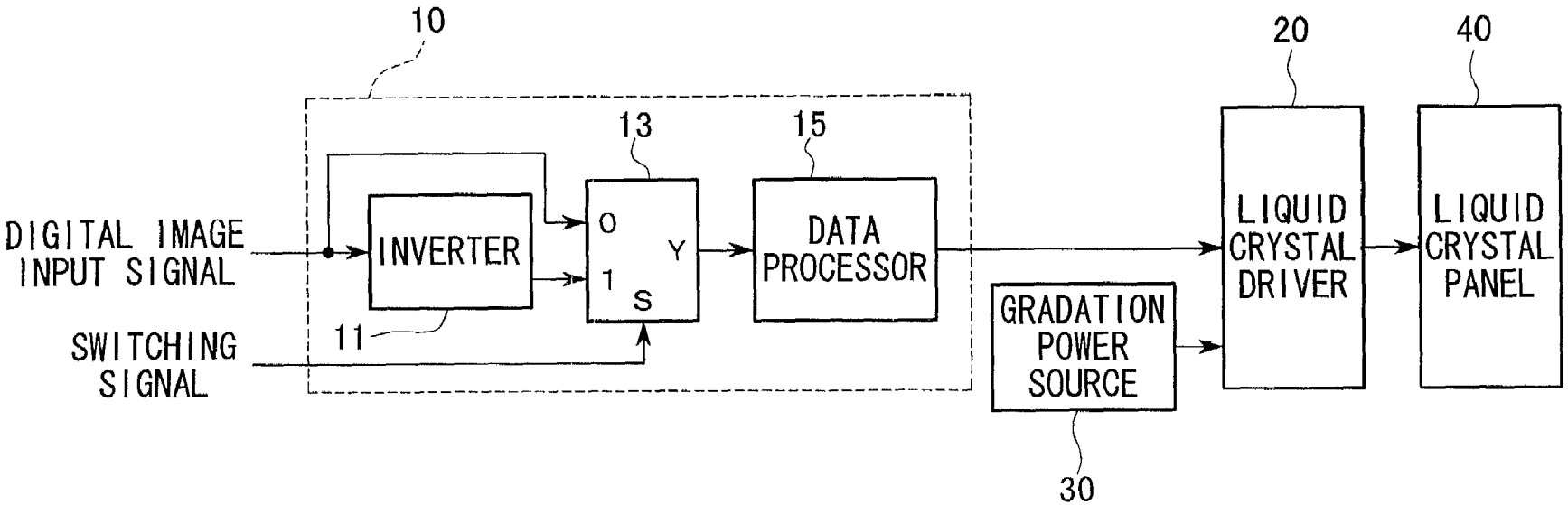
FIG. 1 is a block diagram showing an embodiment of the present invention.

FIG. 1 is a block diagram showing an embodiment of the present invention. The liquid crystal display controller 10 comprises an inverter 11 inverting the digital image input signal, a selector 13 choosing and outputting the signal inverted in the inverter 11 and the digital image input signal depending on a switching signal, and a data processor 15 data-processing the signal transmitted from the selector 13 to be displayed on the liquid crystal panel 40. In the selector 13, the digital image input signal is input to an input terminal 0, the output signal from the inverter 11 is input to an input terminal 1, the switching signal is input to a control input terminal S, and the digital image input signal depending on the switching signal or the output signal from the inverter 11 is transmitted from an output terminal Y to the data processor 15.

The liquid crystal driver 20 is a circuit transmitting a drive signal for showing image information on the liquid crystal panel 40. The liquid crystal driver 20 can be used for either normally white (TN liquid crystal panel) or normally black (transverse electric field liquid crystal panel) liquid crystal panels 40. Of course, according to the liquid crystal panel 40 which is either a TN liquid crystal panel or a transverse electric field liquid crystal panel, the liquid crystal driver 20 may be provided for the types of the liquid crystal panel so as to optimize the sharpness and visibility of images. The gradation power source 30 is chosen depending on the liquid crystal panel 40 which is either a TN liquid crystal panel or transverse electric field liquid crystal panel. The gradation power source 30 generates a voltage for driving the panel depending on the type of liquid crystal panel.

In the above-mentioned display, there are several types of switching signals which are listed as follows.

(1) A type in which the switching signal makes the liquid crystal panel display in either normally white or normally black. For example, a user can switch the screen between normally white and normally black with no dependence on the type of the liquid crystal panel which is either a TN liquid crystal panel or a transverse electric field liquid crystal panel.

(2) A type in which the switching signal makes the liquid crystal panel display whether it is a TN liquid crystal panel or a transverse electric field liquid crystal panel. For example, in the liquid crystal panel, a liquid crystal panel identification terminal may be provided. The liquid crystal panel identification terminal outputs either H or L, depending on the type of liquid crystal panel.

(3) A type in which the switching signal identifies whether the gradation power source is provided for the TN liquid crystal panel or for the transverse electric field liquid crystal panel.

(4) A type in which the switching signal is transmitted from a DIP (dual in-line package) switch provided in the liquid crystal display or from an external μ-processor.

Figure 2:
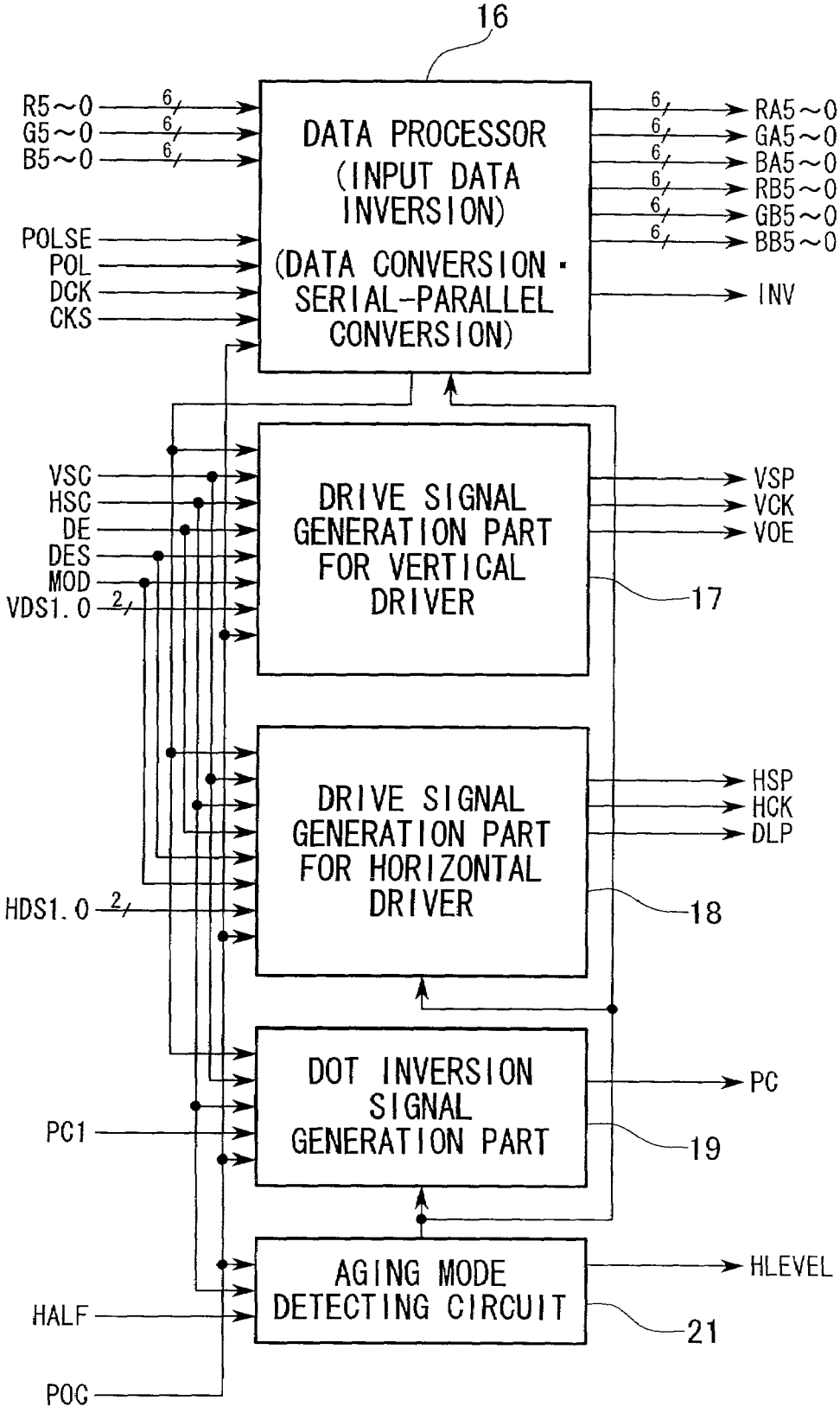
FIG. 2 is a block diagram showing the function of an LSI performing as a data processor.

FIG. 2 is a block diagram showing the function of an LSI performing as a data processor. The LSI performing as the data processor 15 in FIG. 1 comprises a core data processor 16, a signal generation part for driving a vertical driver 17, a signal generation part for driving a horizontal driver 18, a dot inversion signal generation part 19, and an aging mode detecting circuit 21. The core data processor 16 performs input data inversion, data list conversion, and serial-parallel conversion. A signal generation part for driving a vertical driver 17 and a signal generation part for driving a horizontal driver 18 generate the vertical signal of the scanning line shown on the liquid crystal panel 40 and the horizontal signal of the scanning line shown on the liquid crystal panel 40, respectively. The dot inversion signal generation part 19 controls the dot inversion of the liquid crystal cell. To prevent burn-in of the liquid crystal cell due to its always being supplied a specific DC voltage, a positive electric potential and a negative electric potential (not a constant electric potential) are alternately applied to the liquid crystal cell. The aging mode detecting circuit 21 detects whether the liquid crystal panel 40 is in an aging mode, to prevent early failure of the liquid crystal panel 40, or in an ordinary display mode.

FIG. 3 is a block diagram showing arrangements of a parallel driver; FIG. 3A shows a two sided arrangement and FIG. 3B shows a one sided arrangement. The parallel driver 26 is one of the liquid crystal drivers 20. In the two sided arrangement, the parallel drivers 26 are provided at both sides of the liquid crystal panel 40. In the one sided arrangement, the parallel driver 26 is provided at one side of the liquid crystal panel 40. The parallel driver 26 is a single port driver or a multi port driver and RGB serial image data is input to the parallel driver 26 to display a desired image on the liquid crystal panel 40.

Figure 4:
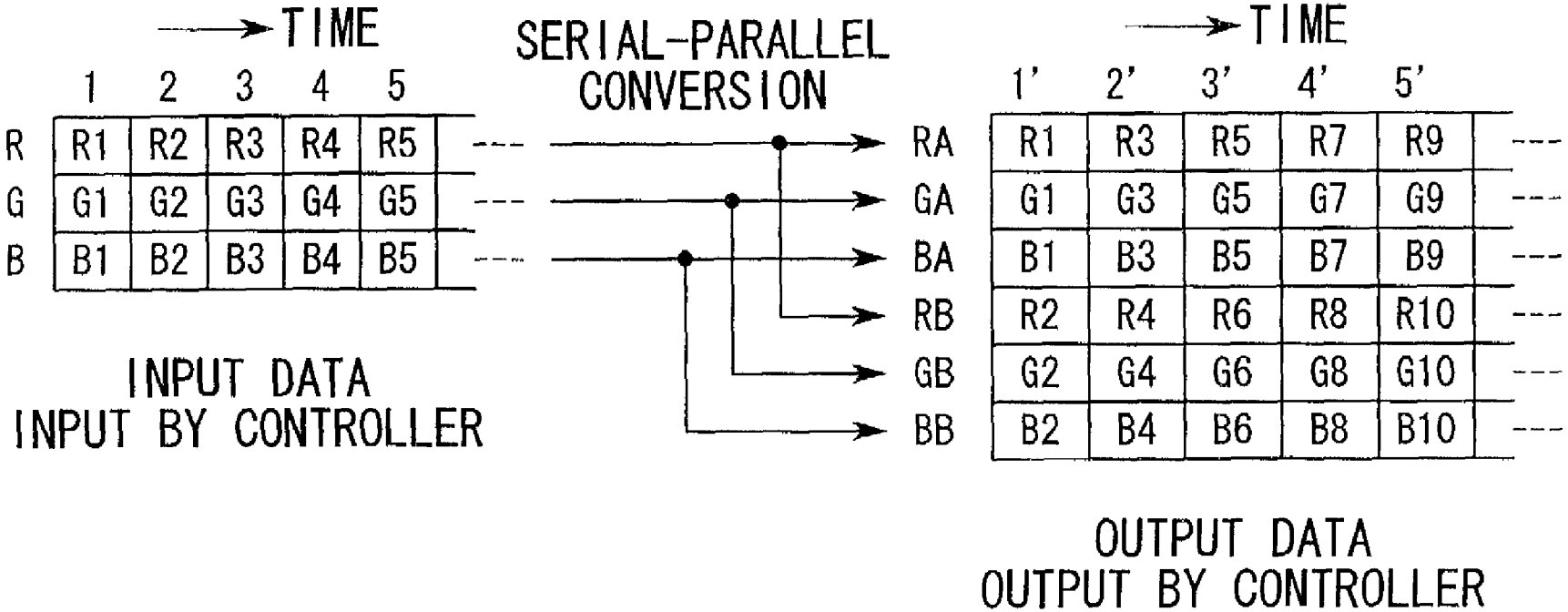
FIG. 4 is a diagram explaining serial-parallel conversion.
Figure 5:
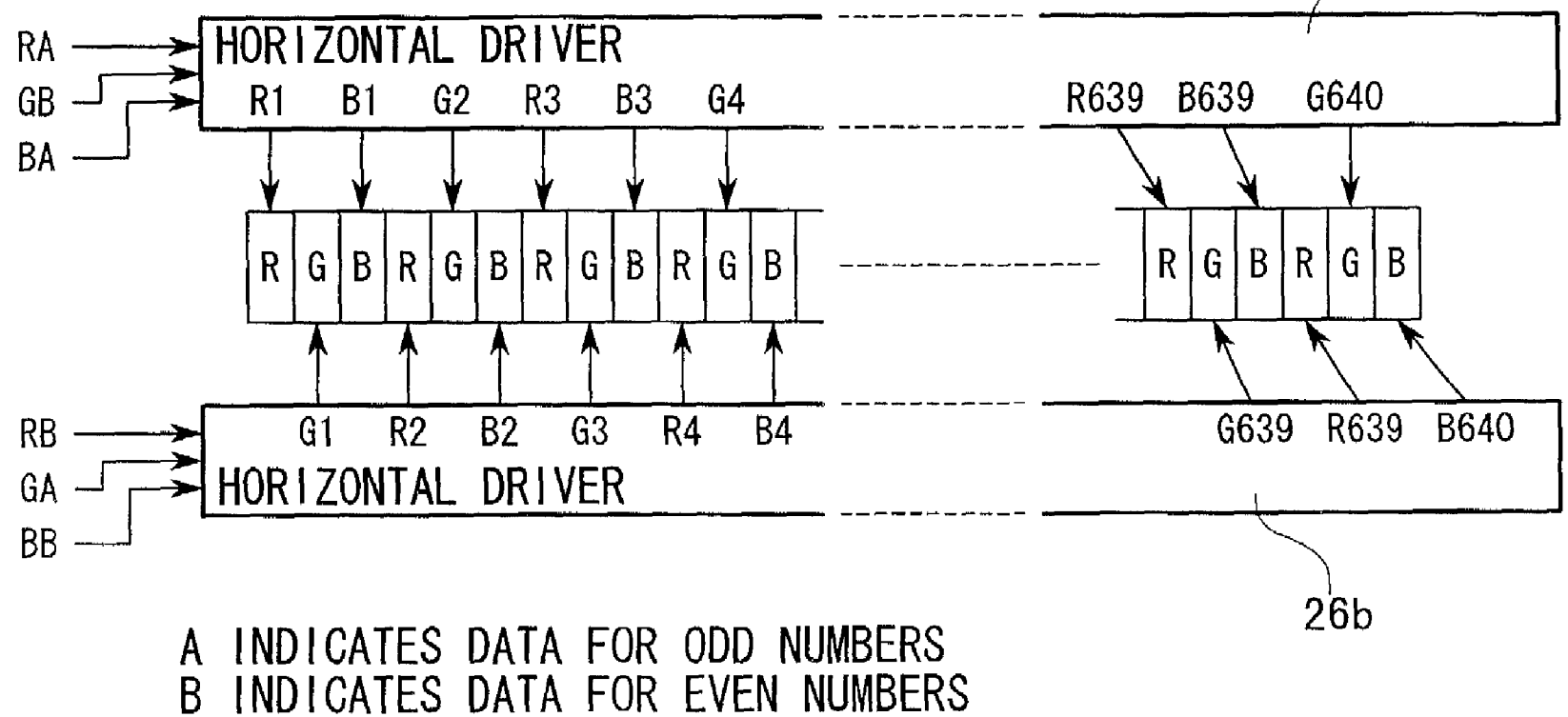
FIG. 5 is a diagram showing the relation between the pixel arrangement and driver connection.
Figure 6:
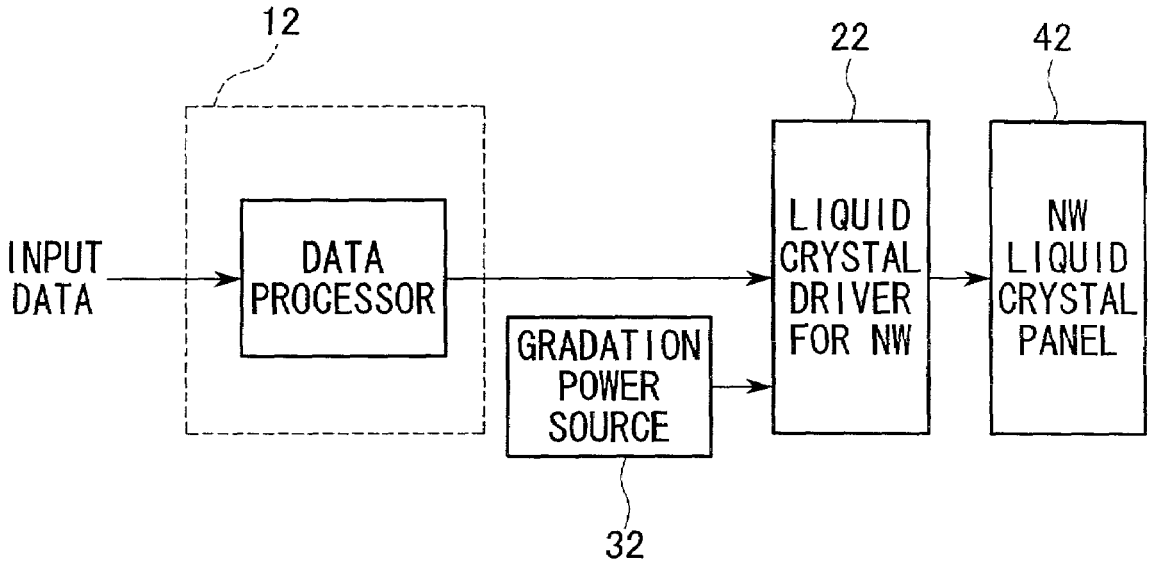
FIG. 6 is a block diagram showing a normally white liquid crystal display.
Figure 7:
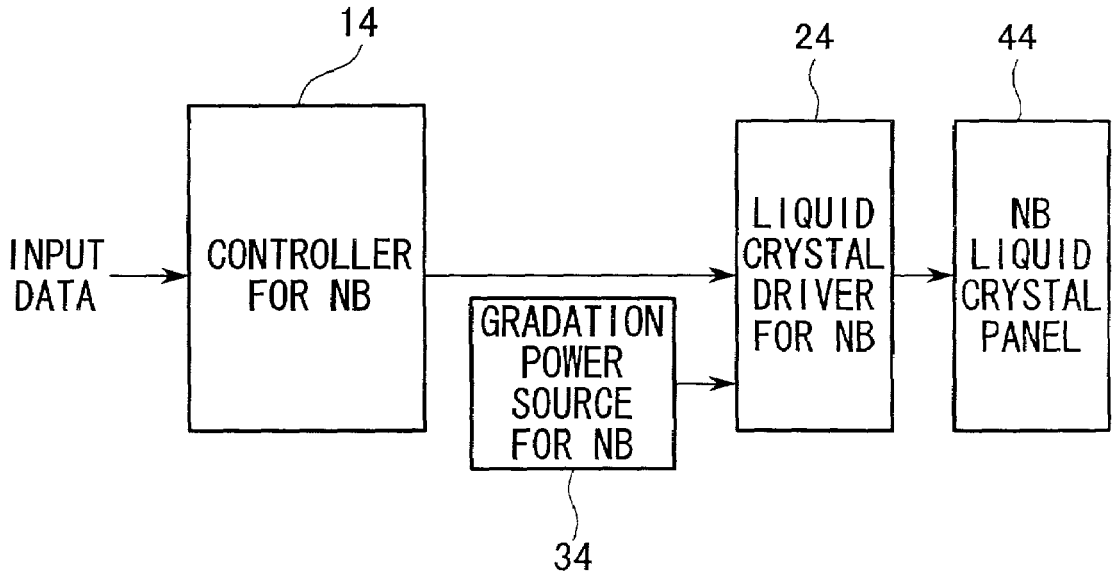
FIG. 7 is a block diagram showing a normally black liquid crystal display.

FIG. 4 is a diagram explaining the serial-parallel conversion. Data into the core data processor 16 is shown as a serial data array; for the three primary colors RGB (red, green, and blue), serial data array are arranged in the direction of increasing time as follows: R1, R2, R3, . . . ; G1, G2, G3 . . . ; B1, B2, B3, . . . . In a video signal, odd numbered and even numbered of scanning lines are alternately shown, so that the output data converted by the serial-parallel conversion is arranged as follows: R1, R3, R5 . . . , G1, G3, G5, . . . ; B1, B3, B5, . . . ; R2, R4, R6, . . . ; G2, G4, G6, . . . ; B2, B4, B6, FIG. 5 is a diagram showing the relationship between the pixel arrangement and the driver connection. In the two sided arrangement, the liquid crystal panel 40 comprises an upper side horizontal driver 26*a* and a lower side horizontal driver 26*b*. According to the sequencing of the data by the data processor 16 in a narrow sense, the data is arranged as R1, B1, G2, R3, B3, G4, . . . , R639, B6369, G640 at the upper side horizontal driver 26*a* for horizontal scanning of the scanning line. On the lower side horizontal driver 26*b*, the data is arranged G1, R2, B2, G3, R4, B4, . . . , G639, R640, B640 for horizontal scanning of the scanning line. Therefore, high speed display is performed on the liquid crystal panel 40.

In the above-mentioned embodiment, a case the inverter and the selector are provided at the input side of the data processor, however, the inverter and the selector may be provided at the output side of the data processor though the image quality is somewhat degraded. A VT control is performed on the data processor. Since this VT control is a non-linear conversion, after the digital image input signal is inverted after the VT control, a second VT control operation will be difficult to perform. Therefore, before the non-linear conversion of the image is performed by the data processor, normally white should be switched to normally black and vice-versa, so as not to affect the VT control.

What is claimed is:

1. A liquid crystal display comprising:

a liquid crystal panel being either normally white or normally black, a gradation power source supplying voltage depending on said liquid crystal panel, a liquid crystal display controller, which comprises:

an inverter for inverting a digital image input signal;

a selector for choosing and outputting a signal inverted by said inverter and said digital image input signal depending on a switching signal;

a data processor for processing data for showing a signal transmitted by said selector on the liquid crystal panel, the data processor comprising a VT control section for a non-linear conversion; and a liquid crystal driver for transmitting the digital image input signal data-processed to the liquid crystal panel using electric power supplied by the gradation power source, and a micro processor or a dual in-line package switch outputting a switching signal for inputting the switching signal to the selector depending on the liquid crystal panel.

2. A liquid crystal display according to claim 1, further comprising plural gradation power sources which are prepared corresponding to types of liquid crystal panels, and are selected depending on the liquid crystal panels to be used.

3. A liquid crystal display controller adapted to control multiple types of liquid crystal display panels comprising:

an inverter for inverting a digital image input signal;

a selector for choosing and outputting a signal inverted by said inverted and said digital image input signal depending on a switching signal, said switching signal is generated based upon a type of multiple types of liquid crystal display panels;

a data process or for processing data for showing a signal transmitted by said selector on one of said multiple types of liquid crystal display panel;

a liquid crystal driver for transmitting the digital image input signal data-processed to said one of said multiple types of liquid crystal display panel; and a micro processor or a dual in-line package switch outputting said switching signal and for inputting said switching signal to the selector depending on said type of multiple types of liquid crystal display panels.

4. The liquid crystal display controller of claim 3, wherein said switching signal is generated based upon an user switching a display mode for said one of said multiple types of liquid crystal display panel between normally black and normally white.

5. The liquid crystal display controller of claim 3, wherein said liquid crystal display controller further includes a liquid crystal identification terminal for identify said type of multiple types of liquid crystal display panels and for outputting a panel identification signal based upon said type of multiple types of liquid crystal display panels.

6. The liquid crystal display controller of claim 3, wherein said liquid crystal display controller further includes a gradation power source identification section for determining a value for said gradation power source outputting a signal based upon said value for said gradation power source.

7. A method for control multiple types of liquid crystal display panels comprising:

a. determining a type of liquid crystal display panel;

b. setting a gradation power supplying voltage depending on said type of liquid crystal display panel;

c. generating a digital image input signal based upon said type of liquid crystal display panel;

d. processing said digital image input signal; and e. transmitting said processed digital image input signal to said liquid crystal display panel using electric power supplied by said gradation power source, wherein step (c) including the sub-steps of:

(i) generating a switching signal based on said type if liquid crystal display panel;

(ii) inverting said digital image input signal; and (iii) selecting either said digital image input signal or said inverted digital image input signal based upon said switching signal.

8. The method of claim 7, wherein step (b) includes the sub-step of selecting from a plurality of gradation power sources one gradation power source based upon said type of liquid crystal display panel.

* * * * *